US006021589A

United States Patent [19]

Cagliari et al.

[11] Patent Number: 6,021,589

[45] Date of Patent: Feb. 8, 2000

[54] DOWN HILL SKI BOOT

[75] Inventors: Cesare Cagliari, Bigolino; Claudio Franco, Montebelluna, both of Italy

[73] Assignee: Lange International S.A., Fribourg, Switzerland

[21] Appl. No.: 09/256,478

[22] Filed: Feb. 23, 1999

[30] Foreign Application Priority Data

Mar. 13, 1998 [CH] Switzerland ..... 0617/98

[51] Int. Cl.[7] ..... A43B 5/04

[52] U.S. Cl. ..... 36/117.1; 36/118.2; 36/119.1

[58] Field of Search ..... 36/117.1, 118.2, 36/119.1, 45, 88

[56] References Cited

U.S. PATENT DOCUMENTS

| | | | |
|---|---|---|---|
| 3,718,994 | 3/1973 | Spier | 36/117.1 |
| 3,798,804 | 3/1974 | Funck | 36/45 |
| 3,807,062 | 4/1974 | Spier | 36/117.1 |
| 3,975,840 | 8/1976 | Juzenko | 36/117.1 |
| 5,647,150 | 7/1997 | Romanato et al. | 36/117.1 |

FOREIGN PATENT DOCUMENTS

| | | |
|---|---|---|
| 0 466032 | 1/1992 | European Pat. Off. . |
| WO 94/21149 | 9/1994 | WIPO . |
| WO 97/27772 | 8/1997 | WIPO . |
| WO 97/35494 | 10/1997 | WIPO . |

*Primary Examiner*—M. D. Patterson
*Attorney, Agent, or Firm*—Bugnion S.A.; John Moetteli

[57] ABSTRACT

A boot comprising a supple upper (1) in the form of a bootie, a brace (2) in the form of a cradle having a triangular structure (14) in the malleolar region, such that a rear bearing surface (8) and a front bearing surface (10) are formed to receive the binding elements. The brace has a partially perforated sole and perforated lateral parts. It is immovably fixed to the supple upper by a plastic material (20) injected around the brace and traversing the perforated portions mentioned above. Such a boot combines comfort and lightness with good control of the foot and a secure fixing of the boot in the ski binding.

5 Claims, 3 Drawing Sheets

DOWN HILL SKI BOOT

BACKGROUND OF THE INVENTION

The invention concerns a down hill ski boot. More particularly, the invention relates to a down hill ski boot having a configuration which combines comfort with secure attachment to a ski binding.

The first ski boots, in leather, were relatively supple. They offered good comfort and permitted an easy stride, thanks to the suppleness of their sole. Finally, to assure the good transmission of force between the foot and the ski, that is to say to reduce the capacity of deformation of the boot, the sole and the upper have become more and more rigid, and the stride, as a consequence, less and less easy. With the appearance of boots in plastic materials, the upper, but more particularly the sole, has acquired a rigidity which assures an excellent interface between the foot and the ski by the intermediary of the ski binding, but yielding a normal stride difficult by reason of the total lack of flexibility of the sole at the level of the metatarsal joint.

For a certain number of years, ways of facilitating the stride with the plastic ski boots by various means were sought. In European Patent No. 0 664 969, the content of which is incorporated by reference, a means is proposed of providing a supple zone forming a hinge in the metratorsal zone of the rigid sole and to divide the shell of the boot into two articulating parts at the level of the said joint, the two parts being among other things, connected by a device permitting locking of the joint.

A boot constructed according to the same principal and which also known is U.S. Pat. No. 5, 572, 806, the content of which is incorporated by reference. This boot differs from the preceding in that the locking device is slidingly mounted within the thickness of the sole. Such boots do not provide a real suppleness permitting a natural operation of the foot during walking. On the other hand, in that it concerns walking, these boots are heavy and of little comfort.

Another approach to the problem, putting to the side the stopgap solutions mentioned above, is described in French patent 2 130 644, the content of which is incorporated by reference. It consists of a sort of auxiliary box in which one encloses the boot to the upper and supple sole.

The boots designed for cross-country skiing certainly have a suppleness at the level of the metatarsal zone in a manner to permit an operation of the foot with a minimum of resistance. These boots are not in all cases fixed in the front and are of a type that the sole cannot have a longitudinal rigidity to the front stop and the heel piece, as is the case with the soles of ski boots in a conventional ski binding, soles which must be sufficiently rigid for supporting the longitudinal thrust applied by the binding and the vertical thrust applied by the brake pedal.

Today, persons practicing leisure skiing would like to find on the market a light and comfortable boot permitting, on the one hand, an easy stride and skiing in good conditions while at the same time, fixing the boot to a ski by means of a binding of the conventional type.

SUMMARY OF THE INVENTION

The invention provides a down hill ski boot which responds to the needs described above.

The down hill ski boot according to the invention is characterized in that it comprises a supple upper in the form of a bootie enveloping the foot, a brace in the form of a cradle which extends laterally around the lower part of the boot, and having a sole which is partially perforated, a heel provided with a rear bearing surface, a front part provided with a front bearing surface, in this way two lateral portions extend from the region of the plantar arch to the malleolar region, and a rear part connected to the upper region of the lateral parts of the heel in such a manner as to form a triangular system on each side of the upper, the sides of this brace being likewise perforated, an articulating collar on the lateral parts of the brace and surrounding the upper part of the upper, the brace being immovably fixed to the supple upper by a supple plastic material injected around the brace and traversing the perforated parts of the brace for tying to the supple upper, as well as to the sides.

The supple plastic material injected around the brace forms therefore a sole under the brace. This sole being among other things generally provided with two plates of relatively hard rubber fixed respectively under the heel and on the lower part of the sole, the supple injected plastic material forms an elastic strata absorbing shock.

According to a preferred embodiment of the invention, the lateral portions of the brace each have an extension extending in one direction or the other, on the lower part of the instep, these extensions being formed to receive a device to which they connect.

The brace is able to have a narrowed portion narrowing from the part forming the sole, the heel and in front of the foot, and perforated, such that the injected supple plastic material does not cover the lower part more thickly than the brace.

BRIEF DESCRIPTION OF THE DRAWINGS

The attached drawings represent, by way of an example, one embodiment of the invention.

DETAILED DESCRIPTION OF THE PREFERRED EMBODIMENTS

Figure 1:
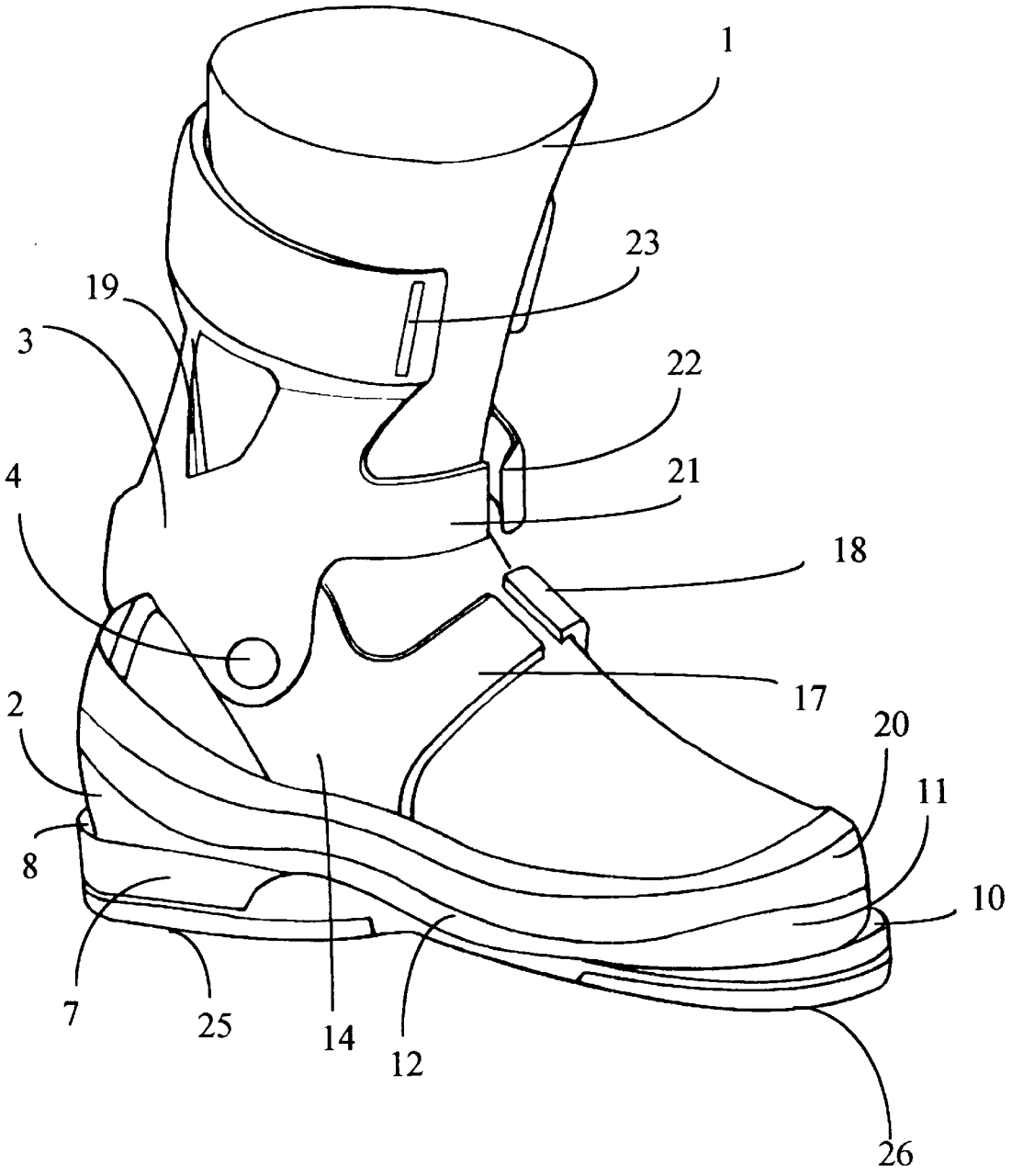
FIG. 1 is a perspective view of the boot not yet equipped with buckles or the lower leg strap.

Referring now to FIG. 1, the boot shown is essentially constituted of a supple upper 1, of a brace 2 and an articulating collar 3 articulating on two opposite points 4 and 5, situated in the malleolar region.

Figure 2:
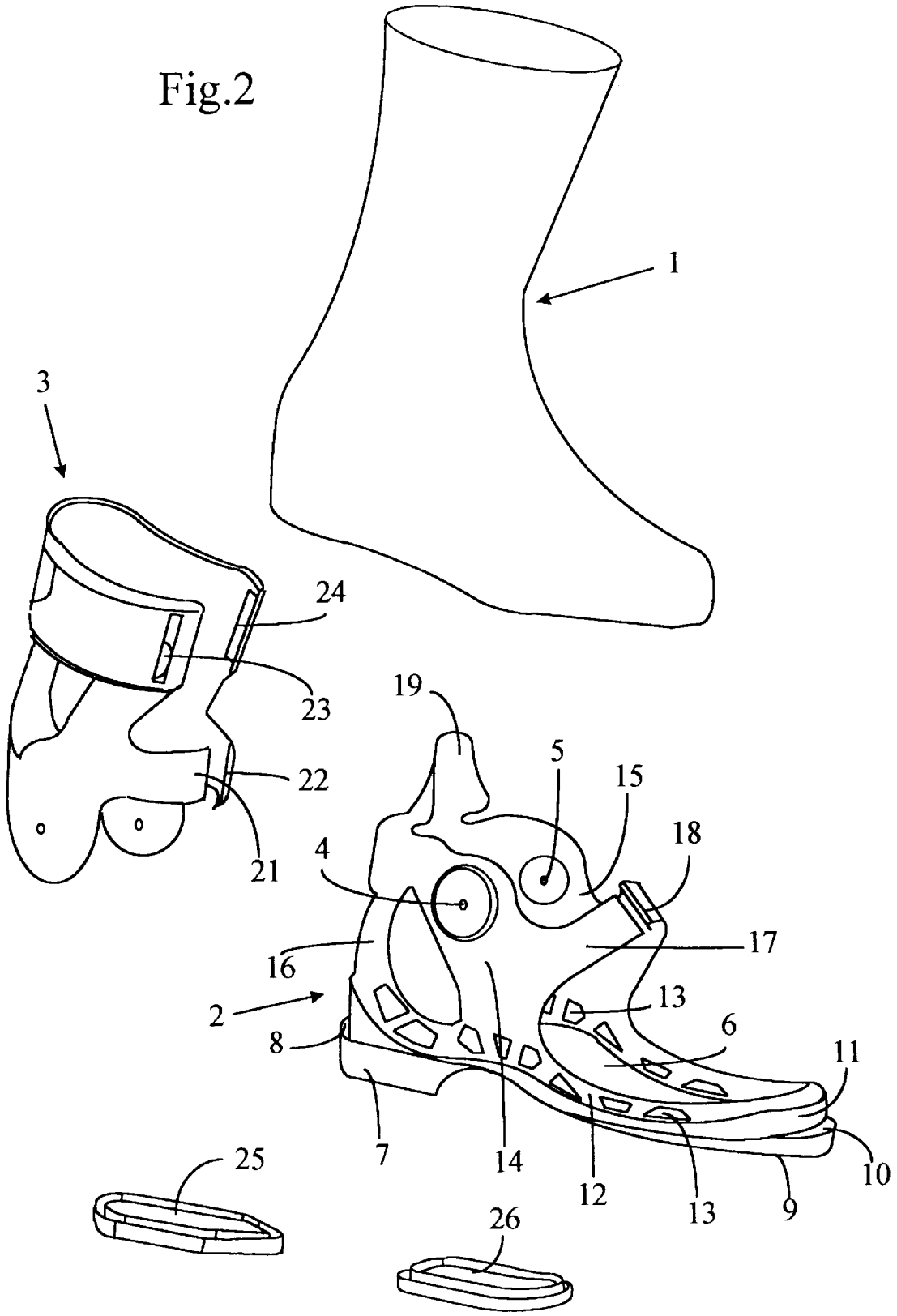
FIG. 2 is an exploded view of the invention of FIG. 1, without the supple material injected around the brace.
Figure 3:
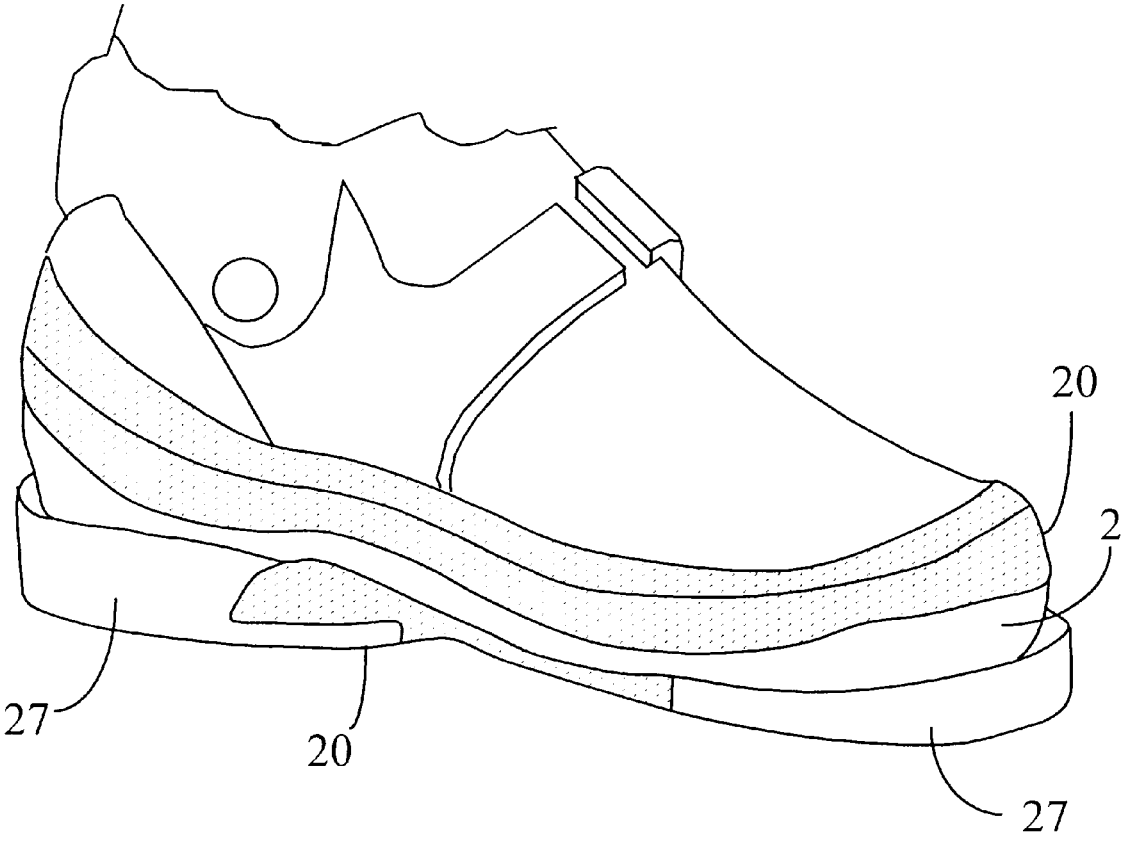
FIG. 3 is an alternative view of the boot of FIG. 1.

Referring as well to FIG. 2, the supple upper 1 has been represented in a highly schematic manner in the form of a closed bootie. In reality, this bootie is open on the front and is closed by two extensions and finally, a tongue passing over the instep. The upper 1 may be made of a supple plastic material having an interior stuffing or a fabric material impregnated with a plastic material or fabricated by any other means.

The brace 2 is preferably made of polyurethane as are the shells of the known ski boots. The brace constitutes a cradle for the upper 1. The cradle extends laterally around the lower part of the upper, from the heel 7 to the extreme front of the boot and has a perforated sole 6, between the heel 7, providing a bearing surface 8, and a front part 9, equally provided with a bearing surface 10, the bearing surfaces 8 and 10 being formed to respectively receive the rear and front ski binding. The front part 9 has among other things a reinforced vertical rounded part 11 formed to receive the support of the jaws of a front binding. The cradle which is formed by the brace has a lateral partition 12 perforated by hole 13 on their two sides. The perforated part is a little thinner than the lower side of the brace.

The brace 2 has, among other things, two, ascending, lateral portions 14 and 15 which extend from the region corresponding to the plantar arch in the direction of the malleolar zone and towards the rear where they reconnect at a rear part 16 surrounding the back of the boot which connects the lateral portions 14 and 15 to the region of the brace comprising the heel 7. The side of the cradle, the lateral portions 14 and 15 and the rear part 16 form, on each side of the boot, a triangular system giving the boot the necessary rigidity for good skiing. The articulation points 4 and 5 are situated in the lateral portions 14 and 15 toward the rear of the instep, aligned with one another. Extensions 17 and 18 are formed to receive a closing and tightening buckle. The brace 2 has among other things, at the rear, a tongue 19, enabling bending toward the rear and formed to insert between the collar 3 and the upper 1 in the zone of the Achilles tendon.

After having placed the upper 1 in the brace 2, the brace and the upper are molded together by the injection of supple plastic material 20 around the brace cradle portion, in such manner that that plastic material 20 also traverses the perforated lateral portions 6, in order to form a cinch surrounding the brace. In this way, the upper 1 and the brace 2 are perfectly connected in the entire plantar region. The plastic material 20 is, for example, made of is expanded polyurethane. As one can see in part in FIG. 1, the plastic material 20 evenly covers the brace, in particular in its central region where it permits the preservation of a certain suppleness that facilitates walking.

The collar 3 is likewise perforated. It is provided, toward the front, 20 with a pair of extensions 21, 22 coming around the upper 1 and formed to receive a buckle. In its upper part, the collar 3 has two passages 23 and 24, formed to receive a strap, preferably a reclosable strap such as a "VELCRO" strap or generic hook and loop fastener, the strap serving, in a known manner, to provide tibial support.

The boot is among other things provided, in a known manner, with a heel plate 25 and a front plate 26, both being made of hard rubber.

The boot described is susceptible to a number of embodiments without departing from the scope of the invention. In particular, the brace 2 may be formed through a multi-injection in such a manner to be flexible in the central zone to facilitate walking. The brace may have hollowed out transversal zones with the same result. The brace 2 may be, among other things, provided with a downwardly projecting portions 27 traversing the material 20 towards the base in such a manner as to replace the heel pad 25 and the front plate 26. The material 20 may be a shock absorbing material. Further, note that some features of the present invention may be employed without corresponding use of the other features. Accordingly, it is appropriate that the appended claims be construed broadly and in a manner consistent with the scope of the invention.

I claim:

1. A downhill ski boot, characterized in that the boot has a heel (7) and an extreme front portion and comprising a supple upper (1) having a lower part compress a bootie which envelops the foot; a brace (2) in the form of a cradle which extends laterally around the lower part of the upper, said cradle having a heel (7) sides which extend from the heel to the extreme front of the boot, and a sole at least partially perforated (6), the heel (7) provided with a rear bearing surface (8), a front part (9) provided with a front bearing surface (10), two portions (14, 15) which laterally extend from the region of the plantar arch to the malleolar region and a rear part (16) connecting an upper region of the lateral parts to the heel in such a manner as to form a triangular system on each side of the upper, the sides of the brace also being perforated (13) and the brace being immovably fixed to the supple upper by a plastic material (20) injected around the brace for adhering to the upper, as well as underneath and on the sides; and a collar (3) rotatably connected to the lateral portions of the brace and surrounding the upper part of the upper.

2. The downhill ski boot according to claim 1, characterized in that the lateral portions (14, 15) of the brace each have an extension (17, 18) extending from the lower part of the instep, the extensions being formed to receive a tightening device to which it is connected.

3. The downhill ski boot according to claim 1 or 2, characterized in that the sole is provided with two plates (25, 26) respectively fixed under the heel and under the front part of the sole.

4. The downhill ski boot according to claim 1 or 2, characterized in that the brace (2) has projecting portions (27) traversing the plastic material (20) toward the base.

5. The downhill ski boot according to claim 1, characterized in that the plastic material (20) is made of a shock absorbing material.

* * * * *

UNITED STATES PATENT AND TRADEMARK OFFICE

CERTIFICATE OF CORRECTION

PATENT NO. : 6,021,589
DATED : FEBRUARY 8, 2000
INVENTOR(S) : CAGLIARI et al.

It is certified that error appears in the above-identified patent and that said Letters Patent is hereby corrected as shown below:

Col. 3, line 33, replace "the front, 20 witz" by -the front, with--;

Col. 4, line 12, replace "comprising" by -comprises--;

Col. 4, line 13, replace "compress" by -comprising--.

Signed and Sealed this

Eighth Day of May, 2001

*Attest:*

Nicholas P. Godici

NICHOLAS P. GODICI

*Attesting Officer*

*Acting Director of the United States Patent and Trademark Office*